US007281874B2

(12) United States Patent
Watanabe et al.

(10) Patent No.: US 7,281,874 B2
(45) Date of Patent: Oct. 16, 2007

(54) THERMAL PRINTER UNIT

(75) Inventors: Sumio Watanabe, Shinagawa (JP); Yukihiro Mori, Shinagawa (JP); Masahiro Tsuchiya, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 392 days.

(21) Appl. No.: 11/106,498

(22) Filed: Apr. 15, 2005

(65) Prior Publication Data

US 2006/0088360 A1 Apr. 27, 2006

(30) Foreign Application Priority Data

Oct. 27, 2004 (JP) ..... 2004-312722

(51) Int. Cl.
*B41F 11/26* (2006.01)

(52) U.S. Cl. ..... 400/691; 400/692; 400/693; 400/120.1

(58) Field of Classification Search ..... 400/690.4, 400/691, 692, 693, 120.1
See application file for complete search history.

(56) References Cited

U.S. PATENT DOCUMENTS 6,450,714 B2 * 9/2002 Mori et al. ..... 400/649
6,899,479 B2 * 5/2005 Hayashi et al. ..... 400/621
2005/0036820 A1 * 2/2005 Watanabe et al. ..... 400/621
2005/0095047 A1 * 5/2005 Watanabe et al. ..... 400/55
2006/0044379 A1 * 3/2006 Ito ..... 347/104
2007/0091162 A1 * 4/2007 Takabatake ..... 347/220

FOREIGN PATENT DOCUMENTS

JP 2000-318260 11/2000
JP 2004230764 A * 8/2004
WO 03/070474 8/2003

OTHER PUBLICATIONS

European Search Report and Annex dated Feb. 10, 2006 of Application No. EP 05 25 2377.

* cited by examiner

*Primary Examiner*—Daniel J. Colilla
*Assistant Examiner*—Kevin D. Williams
(74) *Attorney, Agent, or Firm*—Staas & Halsey LLP

(57) ABSTRACT

A thermal printer unit is disclosed that comprises a main body module, a platen module, and a thermal head module. The platen module is detachably connected to the main body module. The thermal head module is detachably connected to the main body module and the platen module. When the thermal printer unit is installed in a POS device, the platen module is disengaged and separated from the main body module. When the thermal printer unit is installed in a label printer, the thermal head module is disengaged and separated from the main body module.

8 Claims, 18 Drawing Sheets

THERMAL PRINTER UNIT

BACKGROUND OF THE INVENTION

1. Field of the Invention

The present invention relates to a thermal printer unit, and particularly relates to a thermal printer unit applied to a printer section of a device.

2. Description of the Related Art

A typical device that has a thermal printer unit installed in its printer section is a POS (Point-of-Sale) device. Label printers for printing labels, which have been widely used in recent years, also have thermal printers installed in their printer sections.

A thermal printer unit 10 as shown in FIGS. 1A and 1B is commonly used for a clamshell type having a curved paper path and is often installed in POS devices. The thermal printer unit 10 is configured to print on a thermosensitive sheet 14 pulled out from a thermosensitive paper roll 13, wherein a thermal head 12 is movable relative to the platen 11.

A thermal printer unit 20 as shown in FIGS. 2A and 2B is often installed in label printers. The thermal printer unit 20 is configured to print on a liner sheet (hereinafter referred to as "label sheet") 26, which is coated with labels 25, pulled out from a roll 27. The thermal printer unit 20 usually has a thermal head 22 being movable relative to a platen 21 to form a straight paper path, thereby preventing the labels 25 from unexpectedly being released from the label sheet 26.

Most of the thermal printer units for POS devices are designed such that the platen 11 is detachably connectable to the thermal head 12 (see, for example, Japanese Patent Laid Open Publication No. 2000-318260). On the other hand, most of the thermal printer units for label printers are designed such that the thermal head 22 is detachably connectable to the platen 21.

Because of this difference in design, manufacturers of thermal printer units need to produce thermal printer units separately for POS devices and label printers, and therefore suffer from low productivity. Moreover, demand for the thermal printer units for label printers is relatively low compared to the thermal printer units for POS devices, and this further increases the production cost of the thermal printer units for label printers.

Some attempts have been made to develop thermal printer units applicable to both POS devices and label printers. However, thermal printer units designed with a focus on stable operations for the POS devices cannot operate stably when installed in the label printers. Likewise, thermal printer units designed with a focus on stable operations for label printers cannot operate stably when installed in the POS devices. Therefore, dual use thermal printer units have not been put into practical use.

SUMMARY OF THE INVENTION

A general object of the present invention is to provide a thermal printer unit that solves at least one problem mentioned above. A specific object of the present invention is to provide a thermal printer unit applicable to both a POS device and a label printer.

According to an aspect of the present invention, there is provided a thermal printer unit which comprises a main body module, a platen module including a platen, and a thermal head module including a thermal head, wherein the main body module, the platen module and the thermal head module are separable from each other, the platen module and the thermal head module are individually detachably connectable to the main body module, the platen module is detachably connectable to the main body module to which the thermal head module is connected, and the thermal head module is detachably connectable to the main body module to which the platen module is connected.

The thermal printer unit of the present invention can be applied to a printer section of a POS device by attaching and detaching the platen module to the main body module. The thermal printer unit can be also applied to a printer section of a label printer by attaching and detaching the thermal head module to the main body module. Therefore, the thermal printer unit of the present invention is applicable to both the printer section of the POS device and the printer section of the label printer, i.e., applicable to both a device having a curved paper path and a device having a straight paper path.

DETAILED DESCRIPTION OF THE PREFERRED EMBODIMENT

Exemplary embodiments of the present invention are described below with reference to the accompanying drawings.

First Embodiment

[Overview of Thermal Printer Unit 30]

First, an overview of a thermal printer unit 30 of a first embodiment of the present invention is given for convenience of explanation.

Figure 1A:
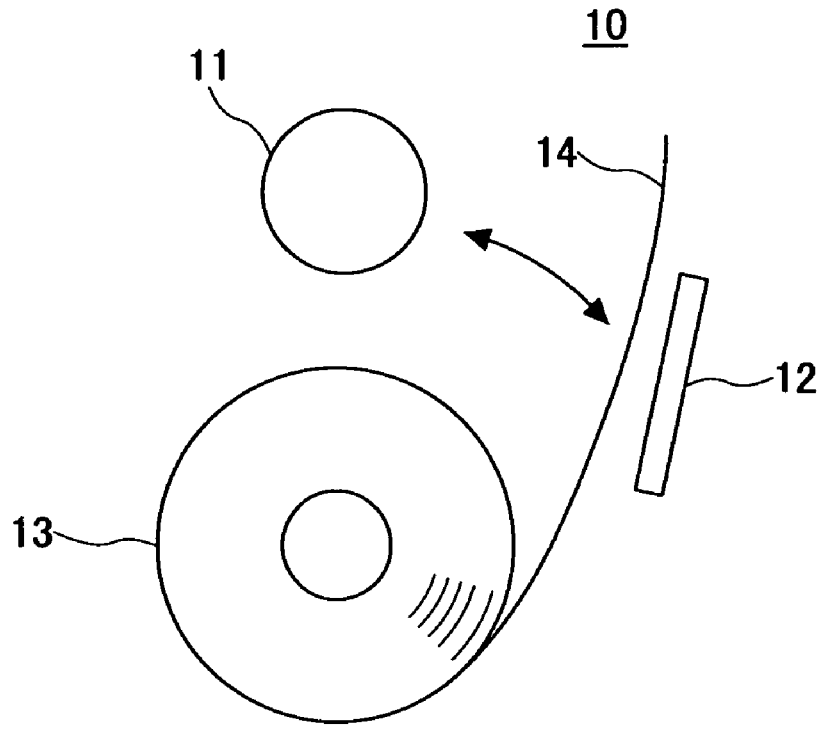
FIGS. 1A and 1B show a thermal printer unit applied to a POS device.
Figure 1B:
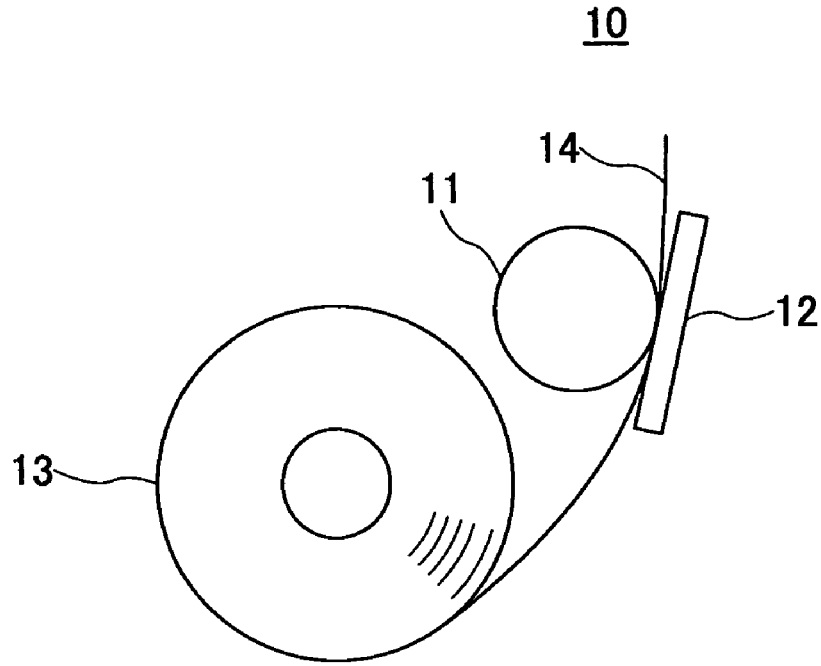
Figure 2A:
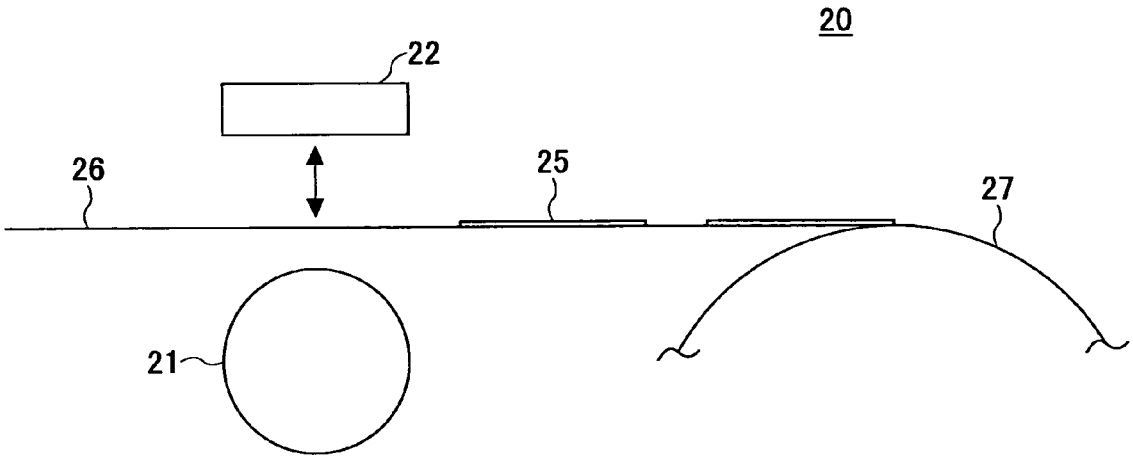
FIGS. 2A and 2B show a thermal printer unit applied to a label printer.
Figure 2B:
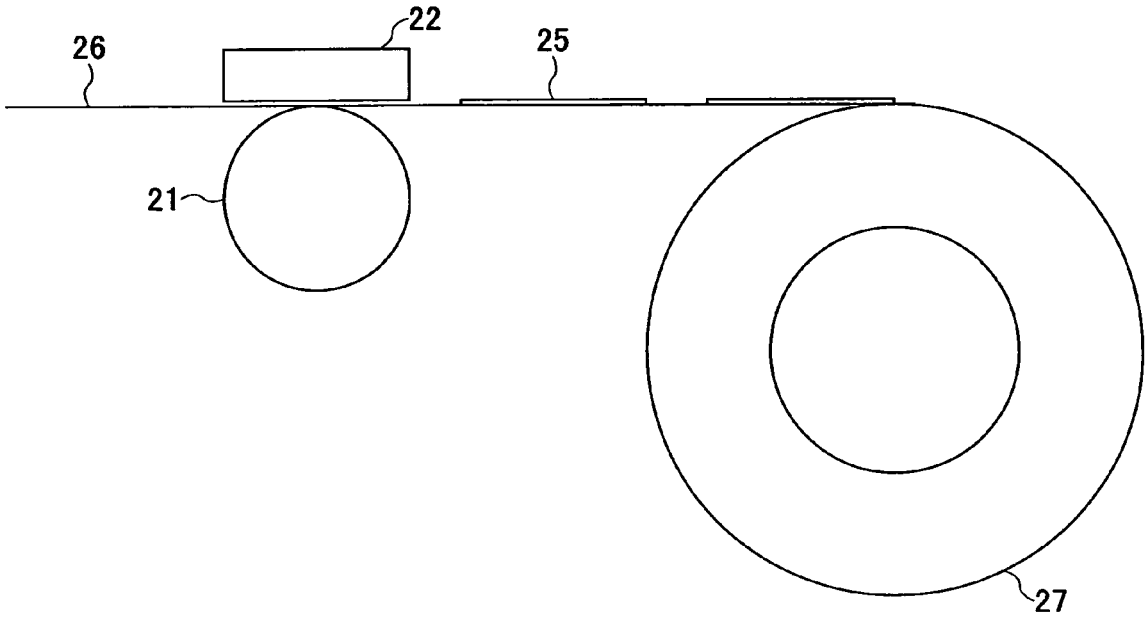
Figure 3B:
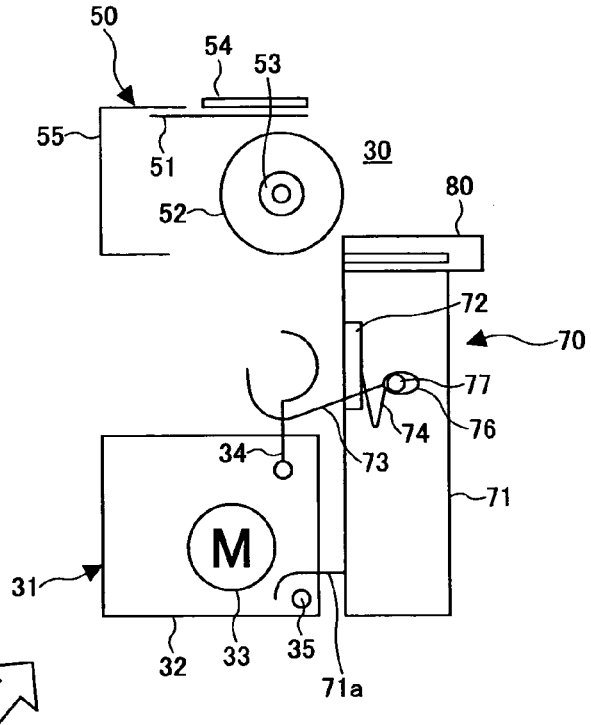
FIGS. 3A through 3C are schematic diagrams showing a thermal printer unit according to a first embodiment of the present invention.
Figure 3A:
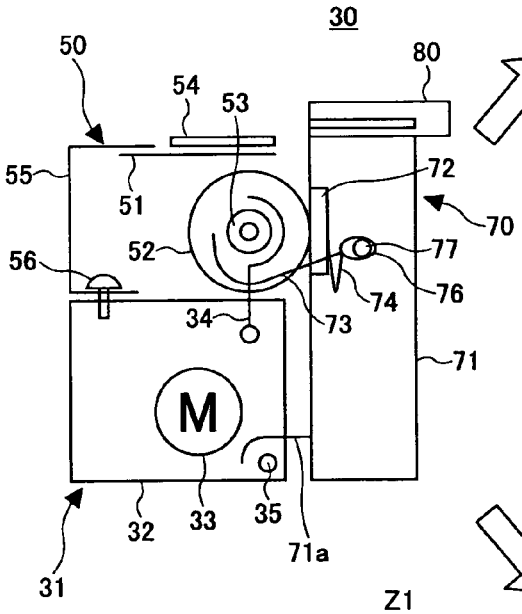
Figure 3A:
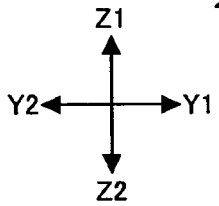
Figure 3C:
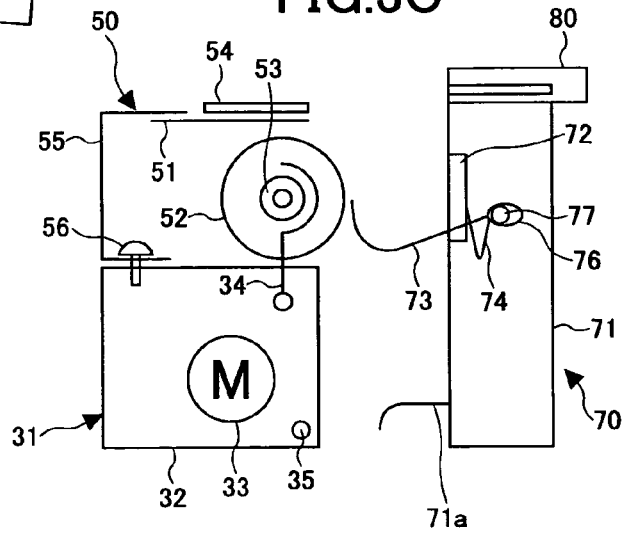

FIGS. 3A through 3C are schematic diagrams showing the thermal printer unit of the first embodiment of the present invention. FIG. 3A shows the thermal printer unit 30 completely assembled.

Although the thermal printer unit 30 is oriented so that a thermal head module faces upward when it is installed in a label printer, the following description is based on the orientation shown in FIG. 3A for the convenience of explanation. X1-X2 indicates a width direction; Y1-Y2 indicates a depth direction; and Z1-Z2 indicates a height direction throughout the drawings.

The thermal printer unit 30 comprises a main body module 31, a platen module 50, and a thermal head module 70, which are separable from each other. The platen module 50 is detachably connected to the main body module 31. The thermal head module 70 is detachably connected to the main body module 31 and the platen module 50.

The main body module 31 comprises a frame 32, a motor 33 arranged inside the frame for rotating a platen 52, first hook levers 34 on the frame 32, and engagement locking pins 35 also on the frame 32.

The platen module 50 comprises a frame 51, the platen 52, a stationary blade 54, and a support assisting member 55, wherein the components 52 through 55 are arranged on the frame 51.

The thermal head module 70 comprises a frame 71, a thermal head 72, second hook levers 73, plate spring members 74, a movable blade unit support member 75, and a movable blade unit 80, wherein the components 72 through 80 are arranged on the frame 71.

In FIG. 3A, the platen module 50 is located at the Z1-side of the main body module 31. The first hook lever 34 engages a ring-shaped platen bearing 53 fitting on a shaft of the platen 52. A setscrew 56 is used for fixing the position. The platen module 50 is thus connected to the main body module 31 at two points spaced apart in the Y1-Y2 direction. The thermal head module 70 is located at the Y1-side of the main body module 31 and the platen module 50. The second hook lever 73 engages the platen bearing 53. A hook section 71*a* engages the engagement locking pin 35. The thermal head module 70 is thus connected to the main body module 31 and the platen module 50 at two points spaced apart in the Z1-Z2 direction. In this state, the platen 52 is in contact with the thermal head 72. The movable blade unit 80 and the stationary blade 54 constitute a cutter 90. The second hook lever 73 engages the platen bearing 53 from the Z2-side. The first hook lever 34 engages the platen bearing 53 from the Y1-side.

FIG. 3B shows a state when the thermal printer unit 30 is installed in a device having a curved paper path such as a POS device, which is described later in detail. As shown in FIG. 3B, when the setscrew 56 is removed and the first hook lever 34 is rotated in the clockwise direction to release the platen bearing 53, the platen module 50 is disengaged from the main body module 31 and separated in the Z1 direction. Since the second hook lever 73 is configured to engage the platen bearing 53 from the Z2-side, the platen module 50 can be separated in the Z1 direction without being blocked by the second hook lever 73.

When the platen module 50 is moved in the Z2 direction, the first hook lever 34 engages the platen bearing 53. In this way, the platen module 50 is connected again to the main body module 31.

FIG. 3C shows a state when the thermal printer unit 30 is installed in a device having a straight paper path such as a label printer, which is described later in detail. As shown in FIG. 3C, when the second hook lever 73 is rotated in the counterclockwise direction to release the platen bearing 53, the thermal head module 70 is disengaged from the platen module 50. Then, the thermal head module 70 is slightly moved in the Z1 direction and separated in the Z1 direction so that the hook section 71*a* disengages the engagement locking pin 35. The thermal head module 70 can be thus separated from the main body module 31 and the platen module 50 in the Y1 direction.

When the thermal head module 70 is moved toward the main body module 31 in the Y2 direction, the hook section 71*a* and the second hook lever 73 respectively engage the engagement locking pin 35 and the platen bearing 53. In this way, the thermal head module 70 is connected again to the platen module 50. While the second hook lever 73 engages the platen bearing 53, the second hook lever 73 is displaced in the Y2 direction. Therefore, the plate spring member 74 is compressed to generate a head pressure. For permitting the above displacement, a hole 76 in which a shaft 77 is placed has a shape elongated in the Y1-Y2 direction.

Figure 4A:
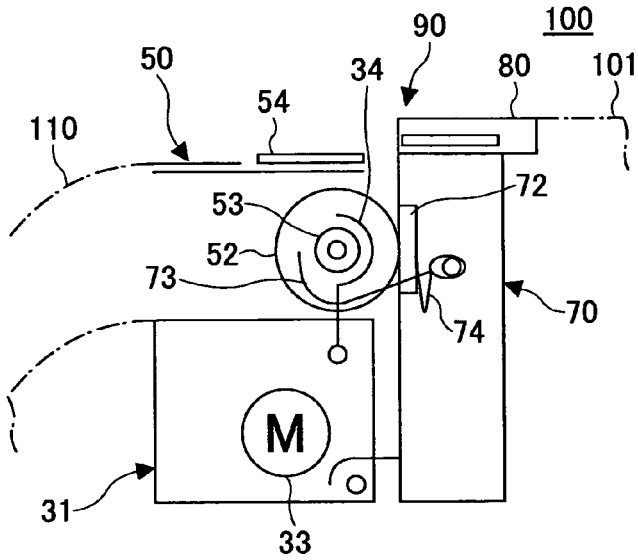
FIGS. 4A through 4C show the thermal printer unit of FIG. 3A installed in a POS device.
Figure 4B:
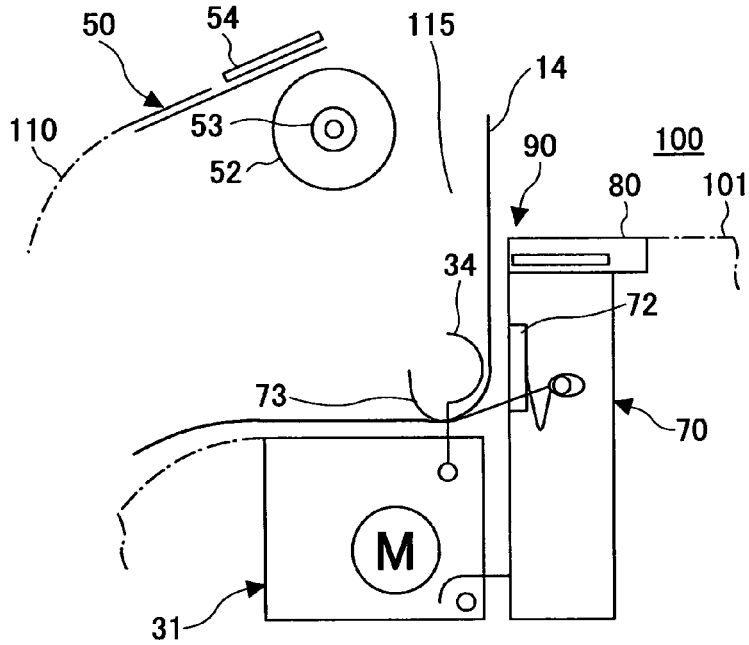
Figure 4C:
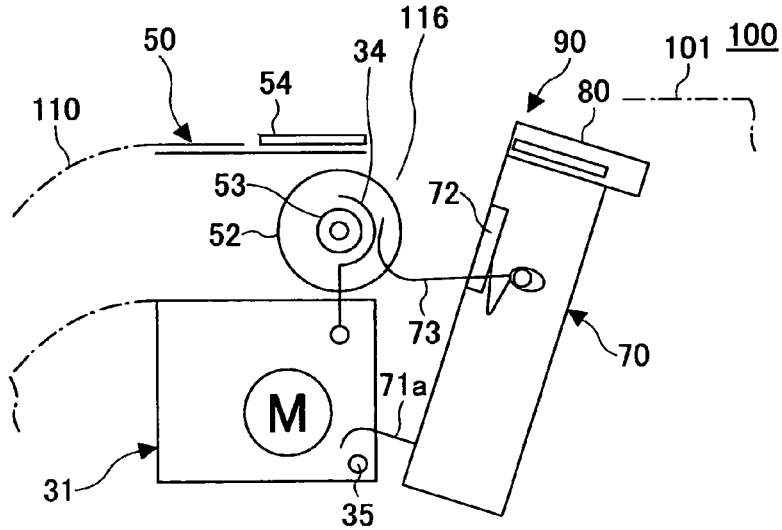

FIGS. 4A through 4C show the thermal printer unit 30 installed in a POS device 100. As shown in FIG. 4A, the support assisting member 55 is removed by removing the setscrew 56. The main body module 31 and the thermal head module 70 are attached to a POS device main body 101, while the platen module 50 is attached to a front end of a pivotally attached lid 110. In FIG. 4A, the lid 110 is closed. In FIG. 4B, the lid 110 is opened for paper loading. When the first hook lever 34 is rotated in the clockwise direction to release the platen bearing 53, the platen module 50 is disengaged from the main body module 31. As such, the lid 110 is opened to open a paper path 115. When the lid 110 is closed after the paper loading, the platen bearing 53 is engaged with the first hook lever 34. The platen module 50 is thus connected to the main body module 31. A thermosensitive sheet 14 is held between the platen 52 and the thermal head 72.

FIG. 4C shows a state of the thermal printer unit 30 during maintenance. The second hook lever 73 is rotated in the counterclockwise direction to release the platen bearing 53, and the thermal head module 70 is slightly rotated about the engagement locking pin 35 in the clockwise direction. The thermal head 72 is separated from the platen 52 to have a space 116 between the thermal head 72 and the platen 52. This space 116 can be utilized for maintenance work on the thermal head 72. The space 116 can be also utilized for fixing paper jams generated at the cutter 90.

The thermal printer unit 30 can be set in the state shown in FIG. 4C by releasing the platen bearing 53 from the second hook lever 73, after the thermal printer unit 30 is assembled or after the POS device 100 with the thermal printer unit 30 installed therein is assembled. This configuration is effective in preventing a part of the platen 52 in contact with the thermal head 72 from being undesirably deformed when the thermal printer unit 30 is not in use.

Figure 5A:
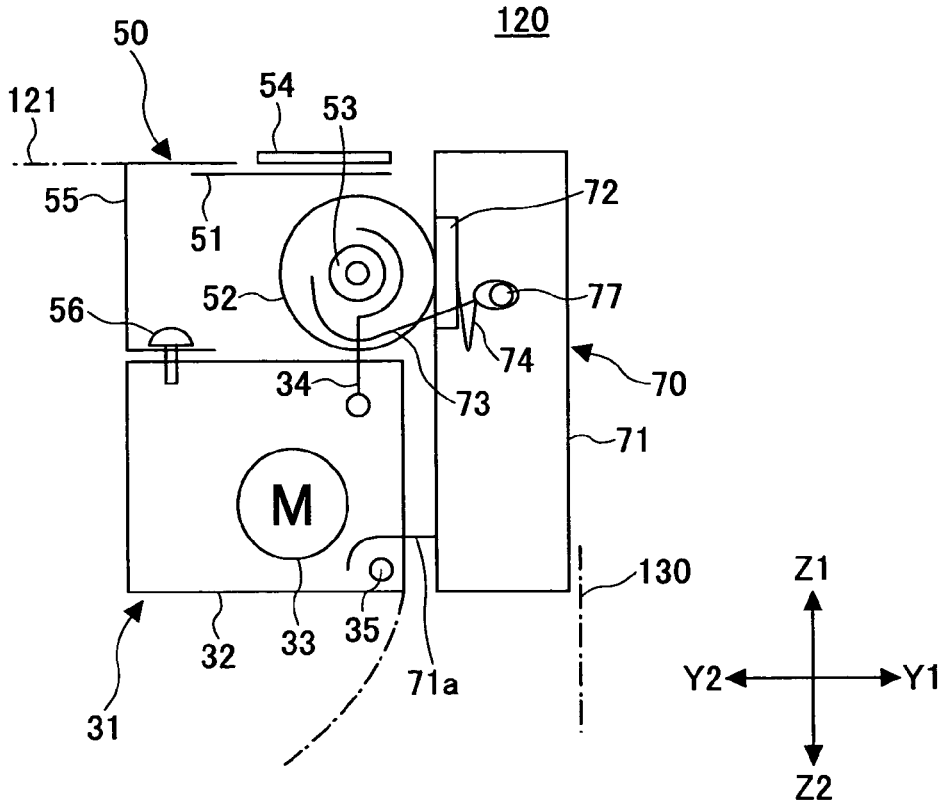
FIGS. 5A and 5B show the thermal printer unit of FIG. 3A installed in a label printer.
Figure 5B:
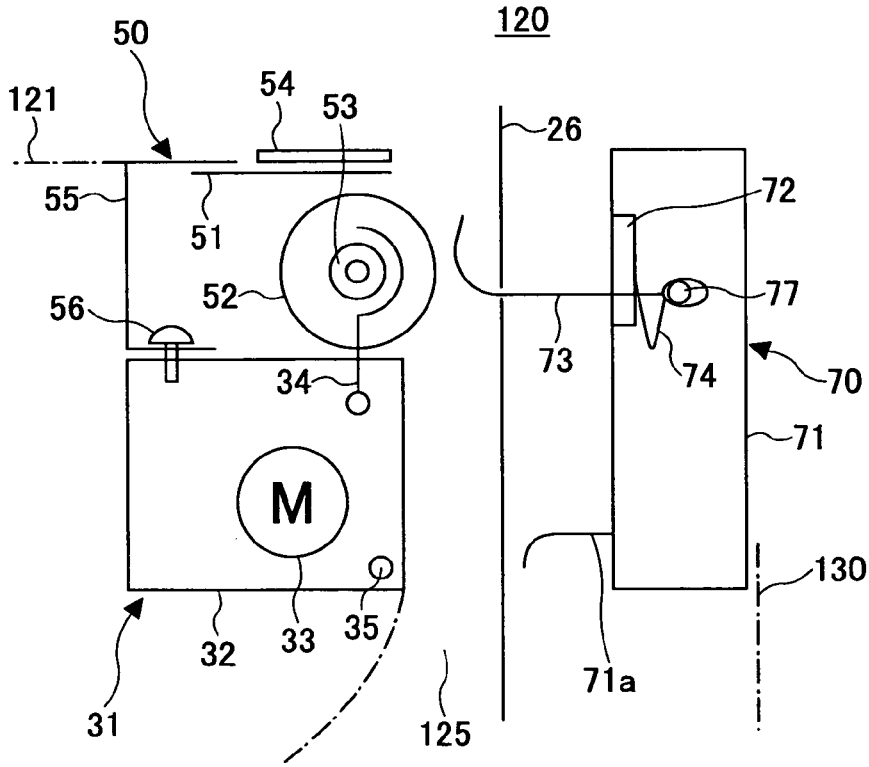

FIGS. 5A and 5B show the thermal printer unit 30 installed in a label printer 120. In FIG. 5A, the main body module 31 and the platen module 50 are attached to a label printer main body 121, and the thermal head module 70 with the movable blade unit 80 removed is attached to a support member 130. The support member 130 shown in FIG. 5A is located in a normal position. In FIG. 5B, the support member 130 is moved in the Y1 direction for loading a label sheet 26. The thermal printer unit 30 is, in fact, oriented so that the thermal head module 70 faces upward. When the second hook lever 73 is rotated in the counterclockwise direction to release the platen bearing 53, the thermal head module 70 is disengaged from the platen module 50 and the main body module 31. Then, the support member 130 is moved in the Y1 direction to open a straight paper path 125. The label sheet 26 is loaded so that a front end thereof passes through the paper path 125. The second hook lever 73 is rotated in the counterclockwise direction, and the support member 130 is moved in the Y2 direction. Then, the second hook lever 73 is rotated in the clockwise direction to engage the platen bearing 53. The thermal head module 70 is thus connected to the platen module 50 and the main body module 31. The label sheet 26 is held between the thermal head 72 and the platen 52.

[Configuration Details of Thermal Printer Unit 30]

Next, the configuration of the thermal printer unit 30 is described in detail. Elements identical those in FIGS. 3 through 5B bear the same reference numbers throughout the drawings.

Figure 6:
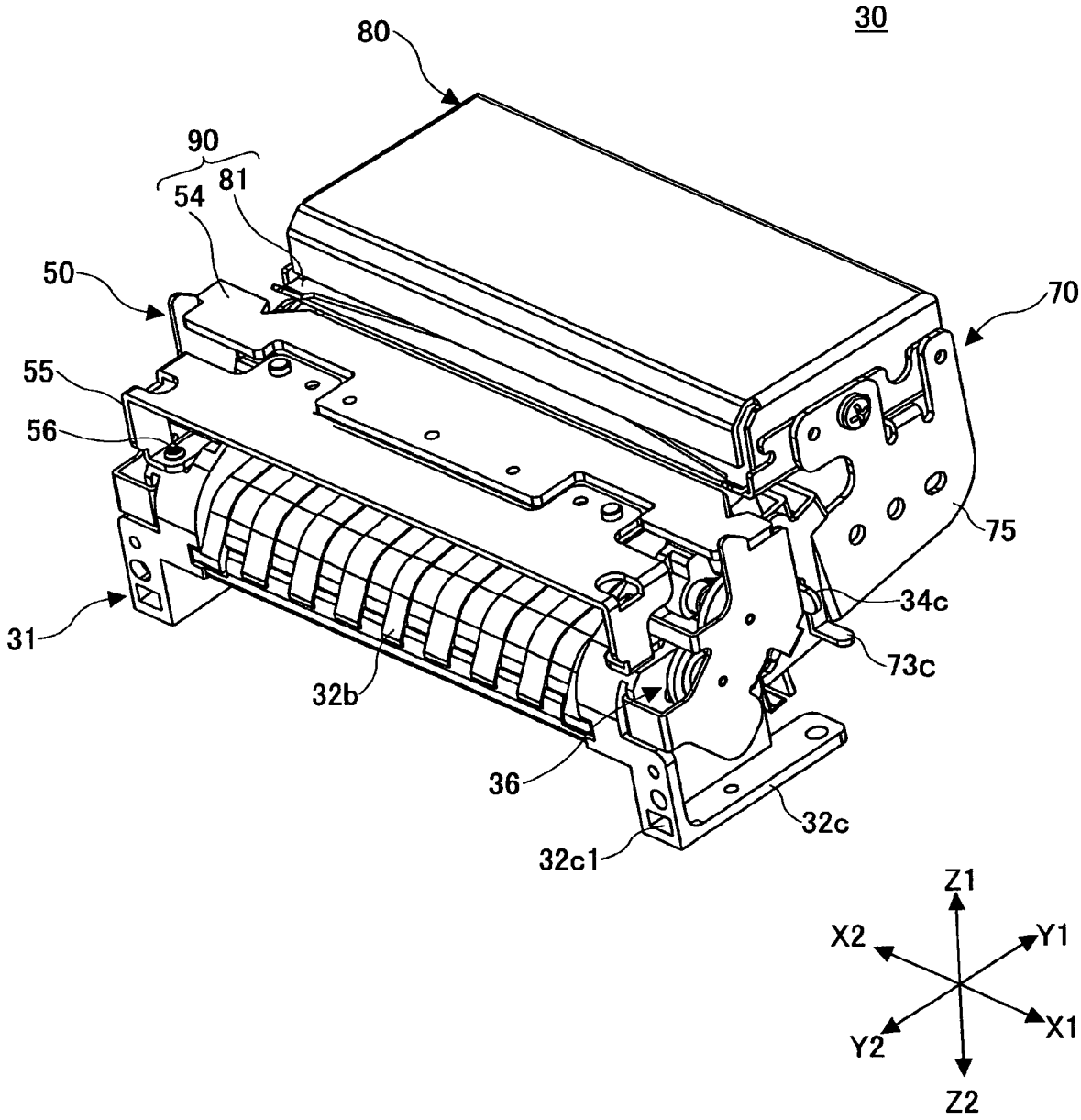
FIG. 6 is a perspective view showing the thermal printer unit.
Figure 7A:
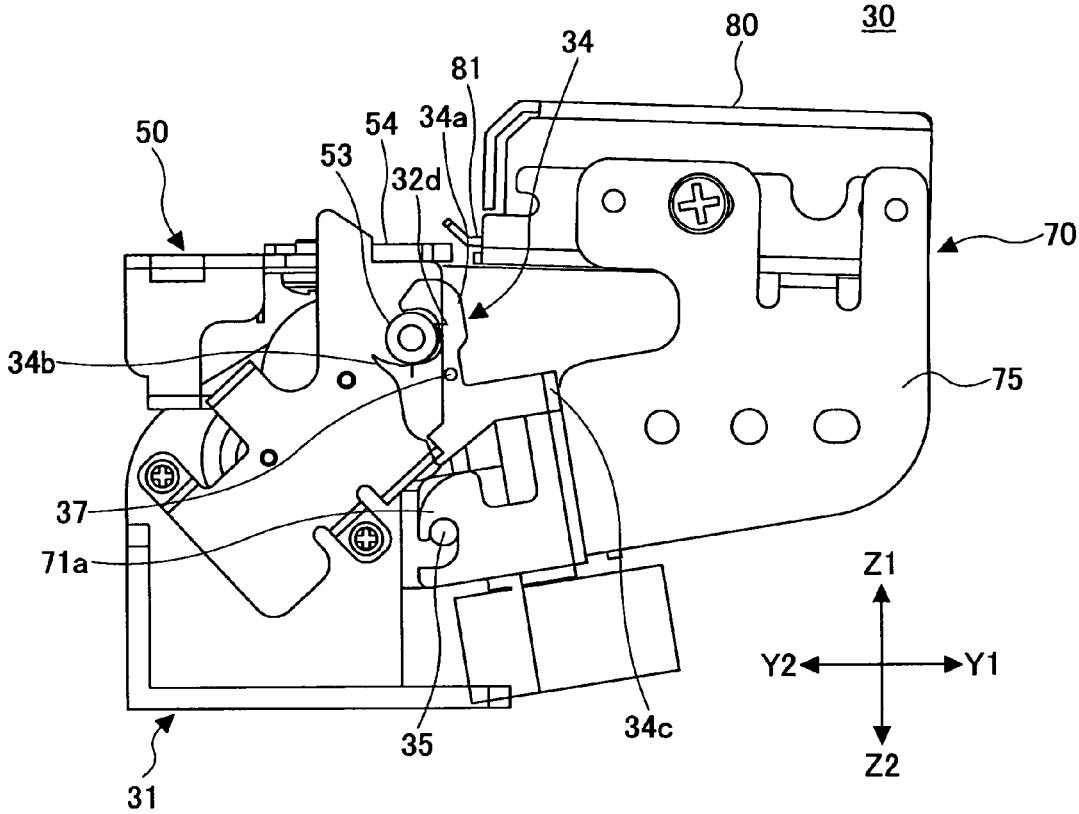
FIGS. 7A and 7B are side views showing the thermal printer unit of FIG. 6.
Figure 7B:
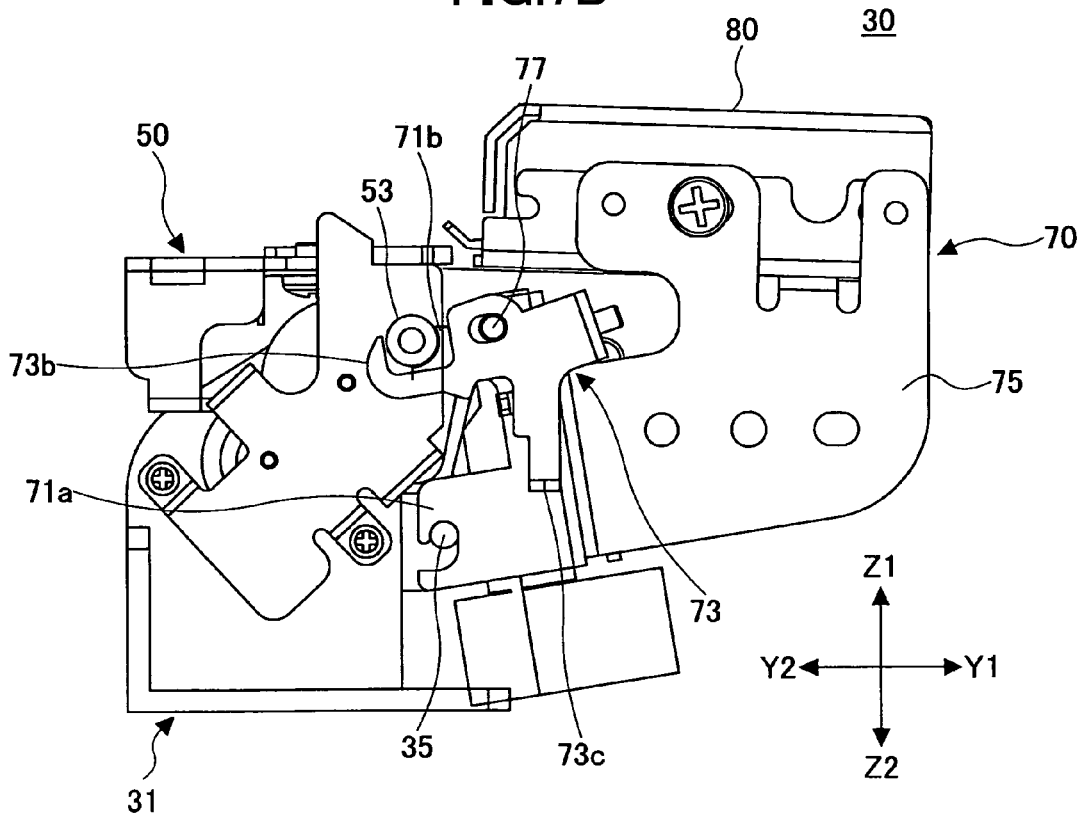
Figure 8:
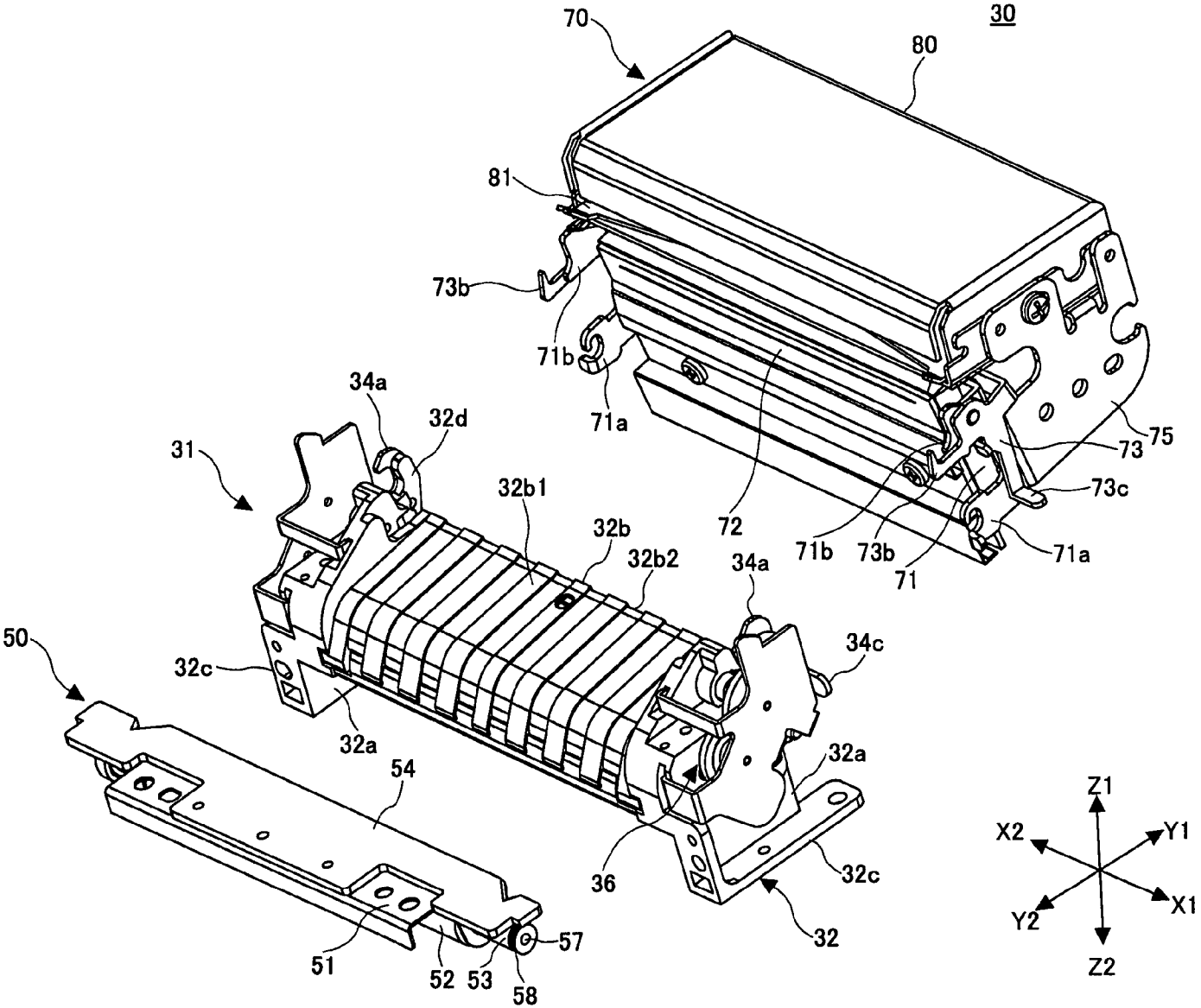
FIG. 8 shows the thermal printer unit with a main body module, a platen module and a thermal head module separated from each other.

FIG. 6 is a perspective view of the thermal printer unit 30. FIGS. 7A and 7B are side views of the thermal printer unit 30. Specifically, FIG. 7A illustrates the first hook lever 34 in detail, and FIG. 7B illustrates the second hook lever 73 in detail. FIG. 8 shows the thermal printer unit 30 with the main body module 31, the platen module 50 and the thermal head module 70 being separated from each other. In FIG. 8, the support assisting member 55 is removed from the platen module 50.

Figure 13:
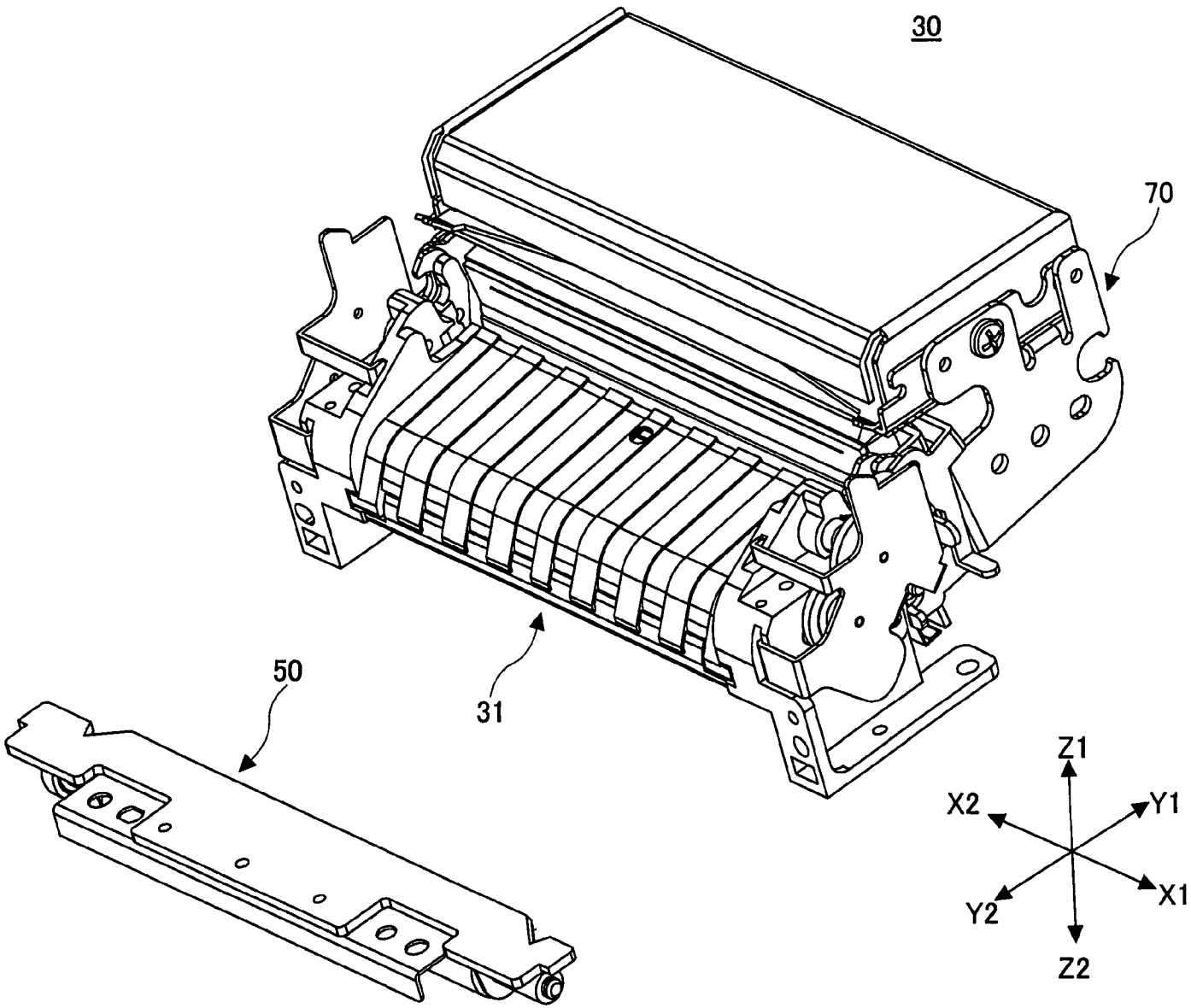
FIG. 13 shows the thermal printer unit of FIG. 6 with the platen module detached therefrom.
Figure 14:
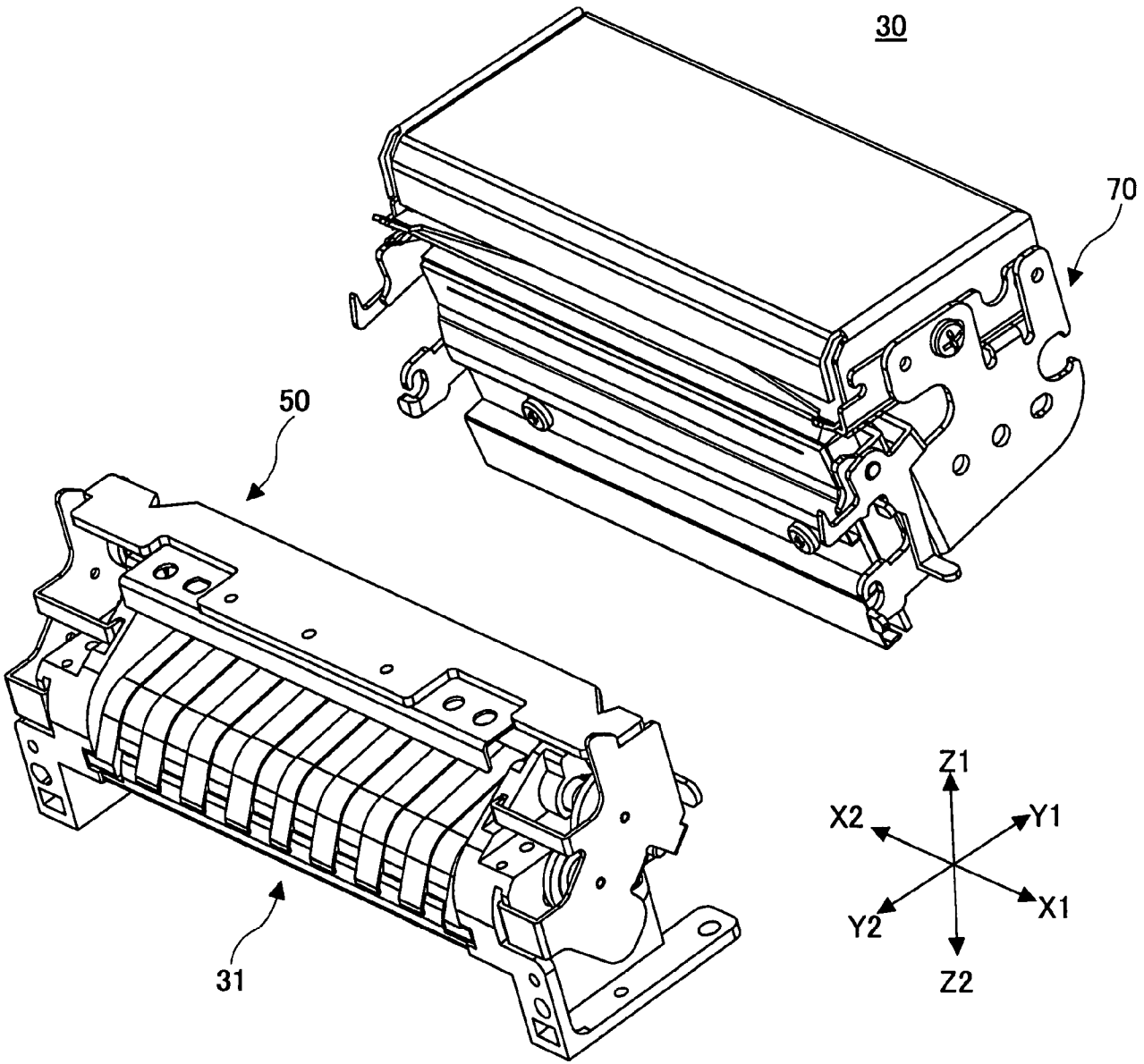
FIG. 14 shows the thermal printer unit of FIG. 6 with the thermal head module detached therefrom.

FIG. 6 and FIG. 13 correspond to FIG. 3B, whereas FIG. 14 corresponds to FIG. 3C.

[Configuration Details of Main Body Module 31]

Figure 9:
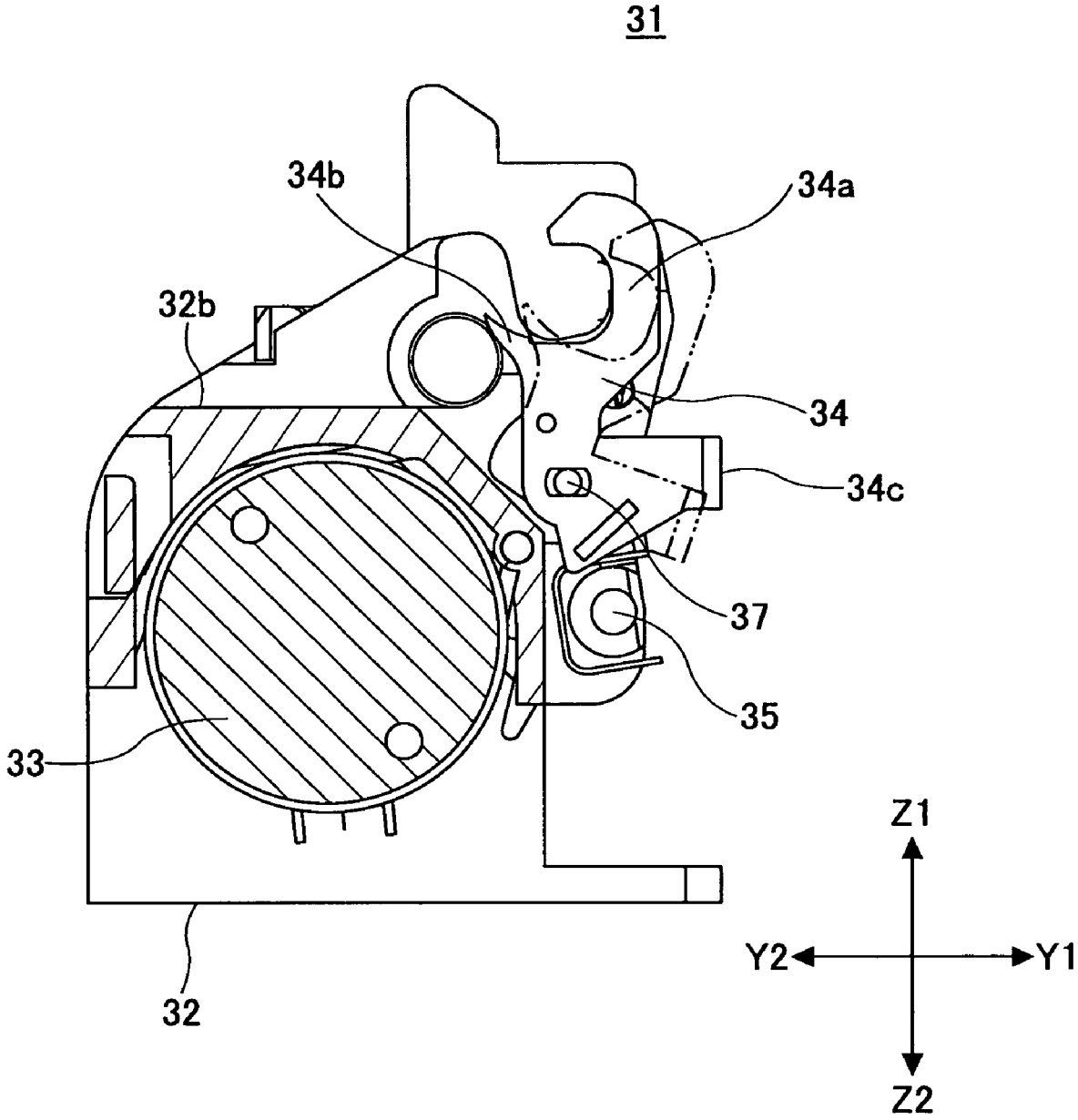
FIG. 9 is a cross-sectional view showing the platen module.

First, the main body module 31 is described in detail referring mainly to FIGS. 8 and 9. The frame 32 comprises side plates 32*a* on both of the X1-side and the X2-side thereof, and a substantially cylindrical paper guide 32*b* between the side plates 32*a*. Each of the side plates 32*a* has an L-shaped leg 32*c* to be attached to the POS device 100 and the label printer 120. Since the leg 32*c* has an L-shape having mutually orthogonal attaching surfaces, the leg 32*c* can be attached to both the POS device 100 and the label printer 120. Bearing receivers 32*d* for receiving the platen bearings 53 are provided at the Z1-side of the side plates 32*a*. The motor 33 is installed inside the paper guide 32*b*. The paper guide 32*b* has a guide section 32*b*1 extending from the Y2-side to the Z1-side, and a guide section 32*b*2 (FIG. 15B) at the Y1-side. A gear set 36 for transmitting the rotation of the motor 33 is provided on the outer surface of the side plate 32*a*. The first hook levers 34 are fixed to respective ends of a shaft 37 (FIG. 15B) rotatably supported between the side plates 32*a*. A spring member (not shown) biases the first hook levers 34 in the counterclockwise direction. As shown in FIG. 7A and FIG. 9, each of the first hook levers 34 has a hook section 34*a* for engaging the platen bearing 53 along the Y1-side and the Z1-side, a finger section 34*b* for engaging the platen bearing 53 along the Y1-side and Z2-side, and a control section 34*c*. The engagement locking pins 35 are arranged on the corresponding side plates 32*a*.

[Configuration Details of Platen Module 50]

Figure 15A:
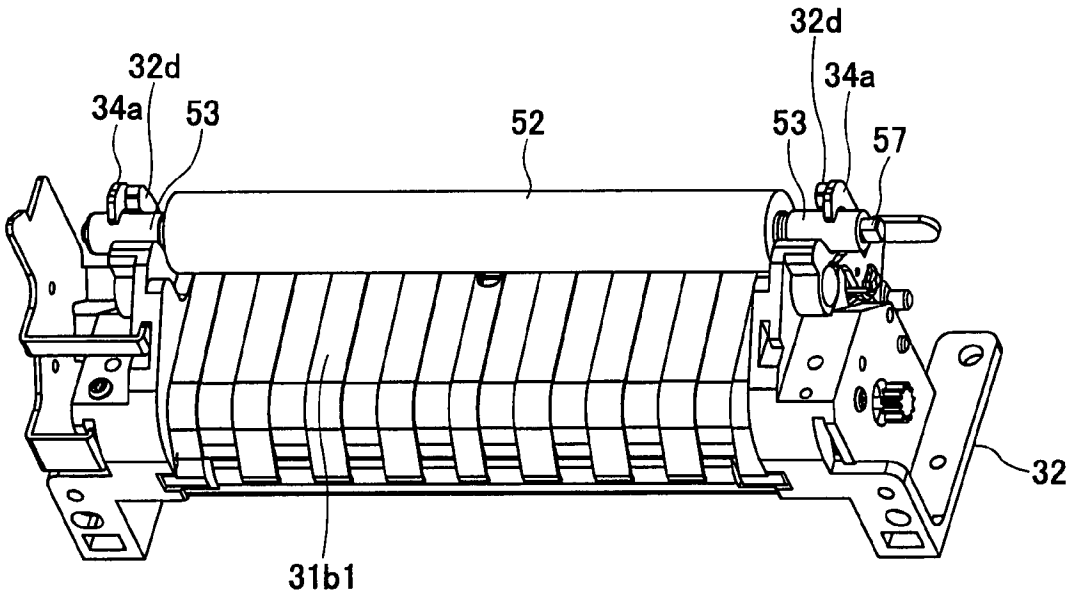
FIGS. 15A and 15B show the main body module with the platen module of FIG. 14 attached thereto.

Next, the platen module 50 is described in detail referring mainly to FIGS. 6 and 8. The platen 52 comprises a through shaft 57 (FIG. 15A). The platen bearings 53 are provided one on each end of the through shaft 57. The portal frame 51 supports the platen bearings 53 of the platen 52 at both side portions thereof. The platen 52 is positioned between the side portions of the frame 51. A gear 58 is fixed to an X1-side end of the shaft 57. The stationary blade 54 is mounted on an upper face of the frame 51 with play. The portal support assisting member 55 is fixed to fit on the frame 51 at the Y2-side of the frame 51.

[Configuration Details of Thermal Head Module 70]

Figure 10:
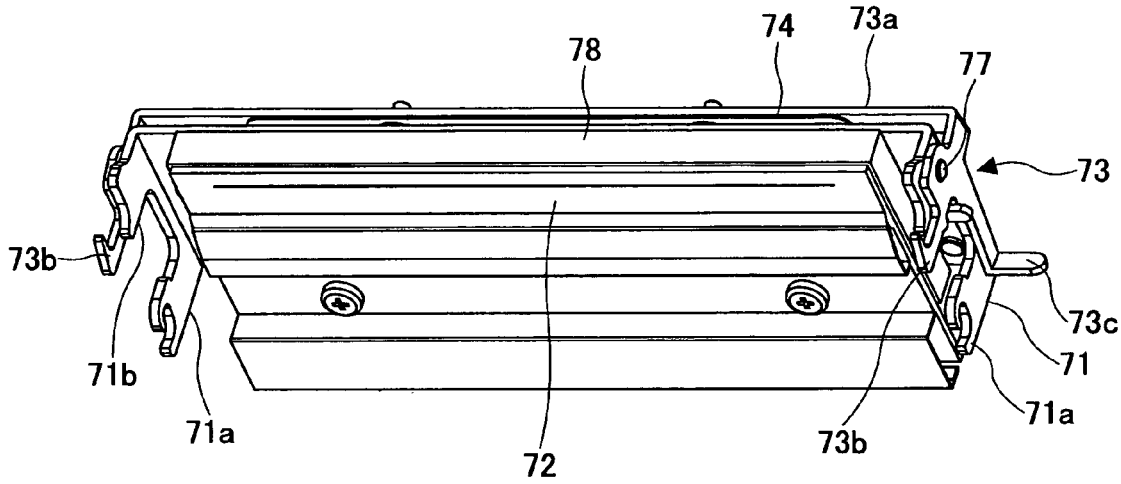
FIG. 10 is a perspective view showing the thermal head module with a movable blade unit removed.
Figure 11:
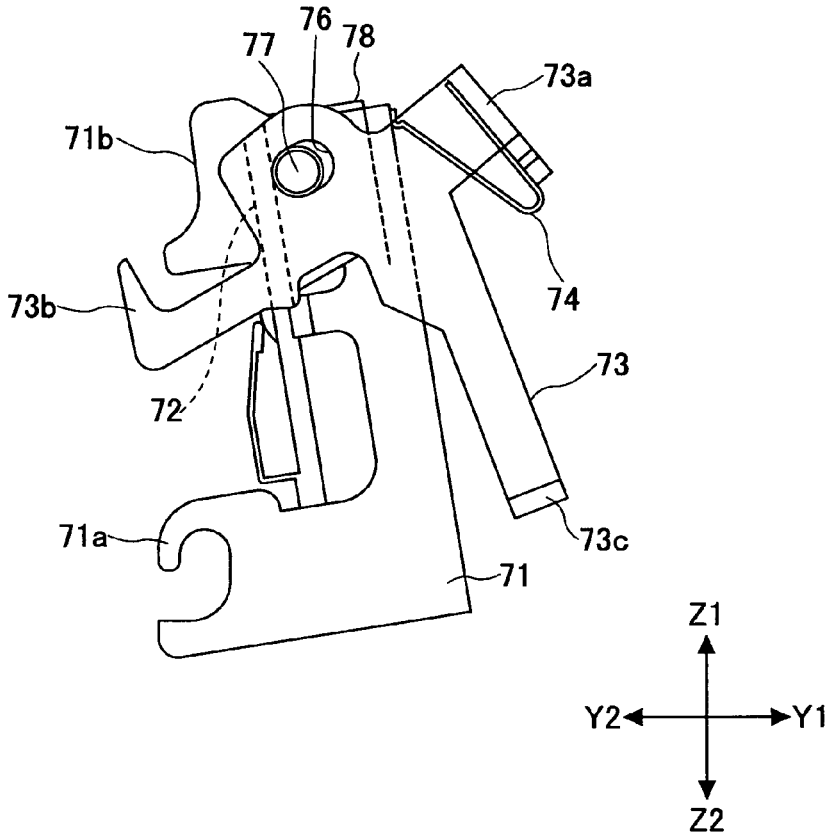
FIG. 11 is an enlarged view showing a second hook lever of the thermal head module and elements related thereto.

The thermal head module 70 is described in detail referring mainly to FIGS. 6, 7B and 8. FIG. 10 shows the thermal head module 70 with the movable blade unit 80 removed. The frame 71 has an angular U-shape, comprising the hook sections 71*a* and the bearing receiver 71*b* on both ends. The hook sections 71*a* are arranged on the Z2-side of the frame 71 to extend to the Y2-side. The bearing receivers 71*b* are arranged on the Z1-side of the frame 71 to extend to the Y2-side. Each of the bearing receivers 71*b* has a recess for receiving and positioning the corresponding platen bearing 53. The shaft 77 is fixed near the bearing receivers 71*b* of the frame 71. The thermal head 72 is fixed to a radiator plate 78, which is fixed to the frame 71 by screws. The thermal head 72 is arranged on the Y2-side of the thermal head module 70. The second hook levers 73 provided one on each side of the thermal head module 70 are interlocked by a cross plate 73*a* extending in the X1-X2 direction. As shown also in FIG. 11, the shaft 77 is fitted in the elongated holes 76 formed on the second hook levers 73. Each of the hook levers 73 comprises a hook section 73*b* for engaging the platen bearing 53 along the Z2-side and the Y2-side, and a control section 73*c*. The plate spring member 74 has a V-shape. An end of the plate spring member 74 is fixed to an inner face of the cross plate 73*a*, while a free end on the opposite side abuts on the back face of the frame 71. The movable blade unit 80 comprises therein a movable blade 81 and a motor mechanism (not shown) for advancing the movable blade 81 in the Y2 direction and retracting the movable blade 81 in the Y1 direction. The movable blade unit 80 is attached on the Z1-side of the frame 71 with both ends supported by the support members 75. The bearing receiver 71*b*, the hook section 73*b*, the plate spring member 74 and the elongated hole 76 constitute a clamping mechanism that clamps the platen bearing 53 of the platen 52 in the Y1-Y2 direction.

[State of Platen Module 50, Thermal Head Module 70 and Main Body Module 31 Attached to Each Other]

The platen module 50 is arranged on the Z1-side of main body module 31 and connected thereto as shown in FIG. 6 and FIG. 7A. The platen bearing 53 is supported by the bearing receiver 32*d* and engaged with the hook section 34*a* of the first hook lever 34. Both ends of the support assisting member 55 are fixed to the frame 32 with the setscrews 56. The platen bearing 53 is held between the bearing receiver 32*d* and the hook section 34*a* in the Z1-Z2 direction. The gear 58 is meshed with an end gear of the gear set 36.

The thermal head module 70 is connected to the main body module 31 and the platen module 50 as shown in FIGS. 6 and 7B. The bearing receiver 71*b* is in contact with the platen bearing 53. The hook section 71*a* is arranged to engage the engagement locking pin 35. The second hook lever 73 is arranged to engage the platen bearing 53. With these two points spaced apart in the Z1-Z2 directions, the position of the thermal head module 70 is determined. Since the bearing receiver 71*b* and the hook section 73*b* hold the platen bearing 53 in the Y1-Y2 direction, the thermal head module 70 is accurately positioned relative to the platen module 50. Accordingly, the thermal head 72 is accurately positioned relative to the platen 52.

Figure 12A:
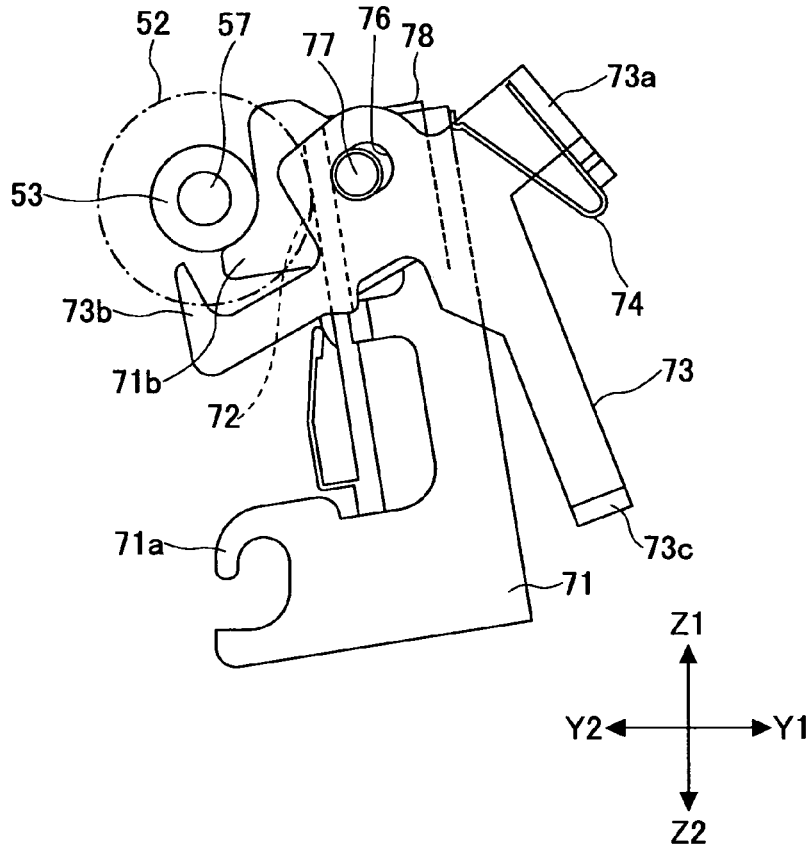
FIGS. 12A and 12B are illustrations of how the second hook lever of the thermal head module locks onto a platen bearing.
Figure 12B:
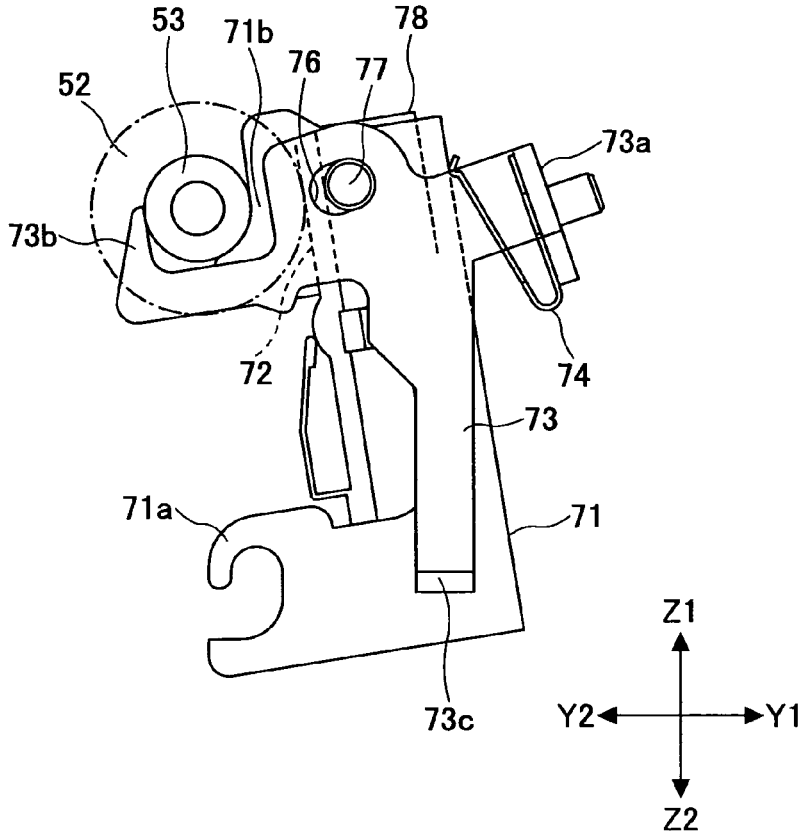

In the process where the second hook lever 73 is rotated in the clockwise direction from a position shown in FIG. 12A to allow the hook section 73*b* to engage the platen bearing 53, the second hook lever 73 is displaced in the Y2 direction as shown in FIG. 12B. The plate spring member 74 is compressed by the displacement of the second hook lever 73. The second hook lever 73 is biased in the Y1 direction with a biasing force generated in the plate spring member 74. Therefore, the platen bearing 53 is pressed against the bearing receiver 71*b*, and the position of the platen bearing 53 is thus fixed. In the meanwhile, the frame 71 is biased in the Y2 direction. Therefore, the thermal head 72 is pressed against the platen 52 to generate head pressure.

The movable blade unit 80 and the stationary blade 54 face each other to serve as the cutter 90. The movable blade 81 is positioned at the Z1-side relative to the stationary blade 54.

The hook section 34*a* and the hook section 73*b* of the second hook lever 73 are arranged side-by-side in the X1-X2 direction.

The hook section 73*b* of the second hook lever 73 is moved from the Z2-side to engage the platen bearing 53. The hook section 34*a* of the first hook lever 34 is moved from the Y1-side to engage the platen bearing 53.

Since the first and second hook levers 34 and 73 engage the platen bearing 53, the platen 52 is freely rotatable.

[Detaching and Attaching Platen Module 50 to Thermal Printer Unit 30]

The setscrews 56 are removed, and the support assisting member 55 is removed in advance. When the control section 34*c* is operated to rotate the first hook lever 34 in the clockwise direction from a position shown in FIGS. 6 and 7A, the platen bearing 53 is disengaged from the hook section 34*a* and lifted in the Z1 direction by the finger section 34*b*. Then, the platen module 50 is released from the main body module 31. The platen module 50 is separated in the Z1 direction as shown in FIG. 13. The second hook lever 73 is configured to approach the platen bearing 53 from the Z2-side to engage therewith, so the platen module 50 can be separated in the Z1 direction without being blocked by the second hook lever 73.

To attach the platen module 50 again to the main body module 31, the platen module 50 is moved in the Z2 direction. With this movement, the platen bearing 53 pushes away the first hook lever 34 to fit into the hook section 34*a*. The platen bearing 53 also pushes the finger section 34*b* in the Z2 direction, so that the first hook lever 34 is rotated in the counterclockwise direction. Thus, the platen bearing 53 is engaged with the first hook lever 34. In this way, the platen module 50 is attached again to the main body module 31.

[Detaching and Attaching Thermal Head Module 70 to Thermal Printer Unit 30]

Figure 15B:
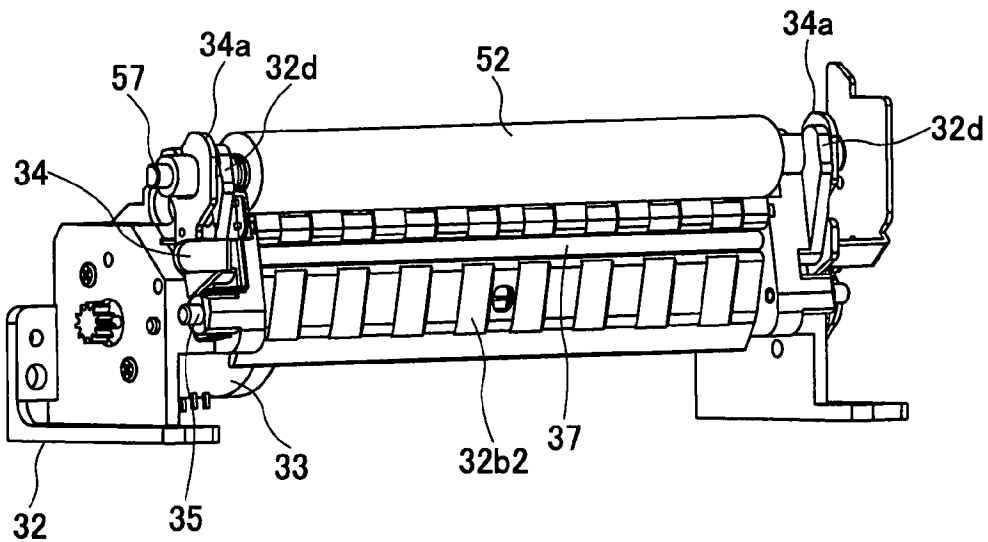

When the control section 34*c* is operated to rotate the second hook lever 73 in the counterclockwise direction from the position shown in FIGS. 6 and 7B, the platen bearing 53 is disengaged from the hook section 73*b* as shown in FIG. 12A. Then, the thermal head module 70 is slightly moved in the Z1 direction so that the hook section 71*a* disengages the engagement locking pin 35. The thermal head module 70 is released from the platen module 50. The thermal head module 70 is separated from the main body module 31 and the platen module 50 in the Y1 direction as shown in FIG. 14. FIGS. 15A and 15B show the main body module 31 with the platen module 50 attached thereto from the Y1-side. In FIGS. 15A and 15B, the frame 51 is removed from the platen module 50 in order to show how the platen 52 is connected to the main body module 31.

The thermal head module 70 is attached again to the platen module 50 and the main body module 31 with the following steps. First, the hook section 71*a* of the thermal head module 70 engages the engagement locking pin 35. Then, the second hook lever 73 is rotated in the counterclockwise direction. The movable blade unit 80 of the thermal head module 70 is moved closer to the platen module 50. The second hook lever 73 is rotated in the clockwise direction to engage the platen bearing 53. In this way, the thermal head module 70 is attached again to the platen module 50 and the main body module 31.

As can be seen, the platen module 50 and the thermal head module 70 can be individually attached or detached to the thermal printer unit 30 in desired order. When the platen module 50 is detached, the platen 52 is separated from the thermal head 72 without affecting the engagement of the second hook lever 73 of the thermal head module 70 and the platen bearing 53. Likewise, when the thermal head module 70 is detached, the thermal head 72 is separated from the platen 52 without affecting the engagement of the first hook lever 34 of the main body module 31 and the platen bearing 53.

[Storing Thermal Printer Unit 30]

When the thermal printer unit 30 is assembled in a factory and stored for shipment, the thermal head 72 is kept out of the contact from the platen 52 as shown in FIGS. 6 and 7B with the following steps. The second hook lever 73 is rotated in the counterclockwise direction to disengage the second hook lever 73 from the platen bearing 53. The thermal head module 70 is slightly rotated about the engagement locking pin 35 in the clockwise direction, so that the thermal head 72 is separated from the platen 52. This prevents a part of the platen 52 in contact with the thermal head 72 from being undesirably deformed.

[Installing Thermal Printer Unit 30 in POS Device 100]

Figure 17:
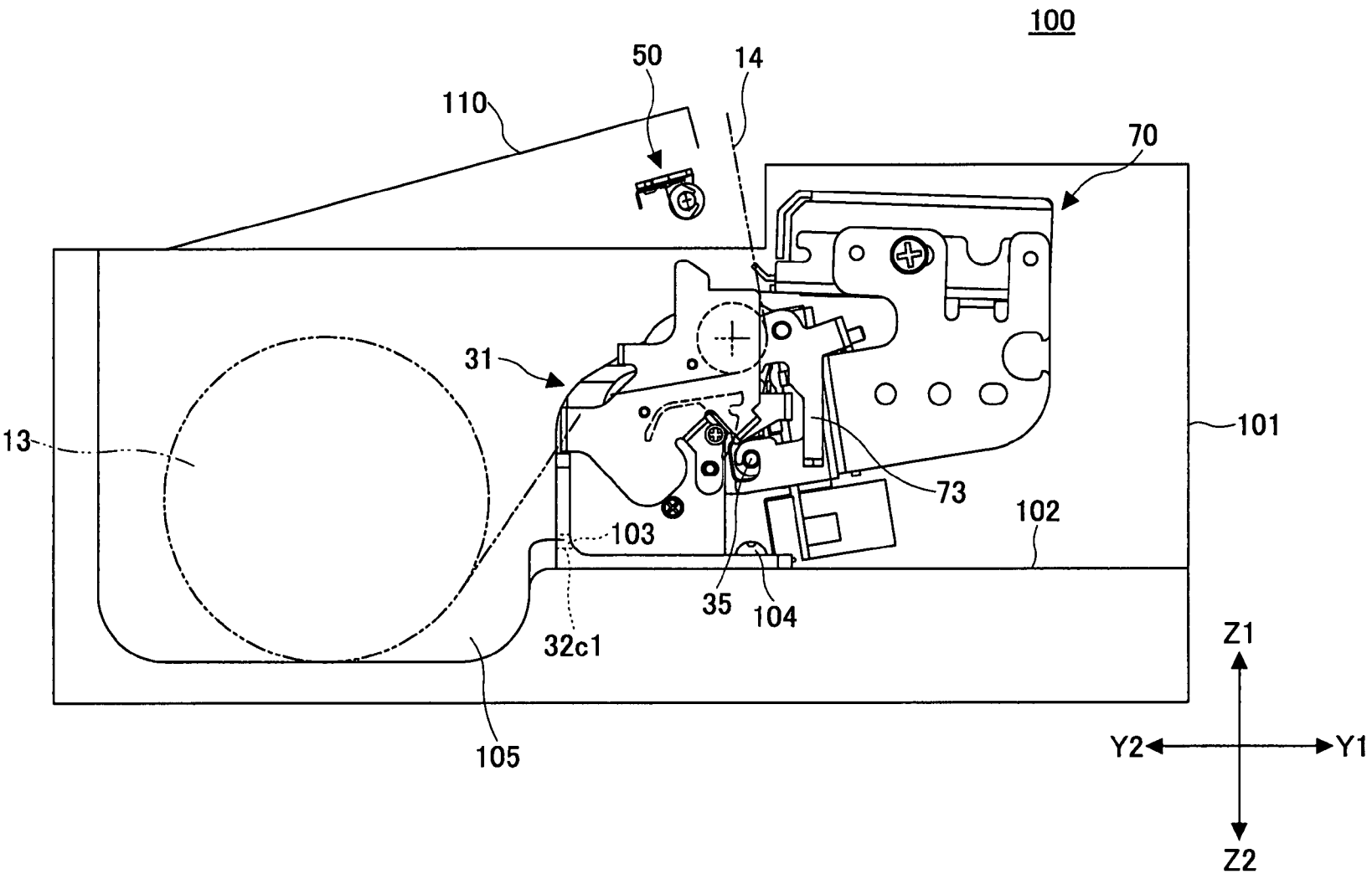
FIG. 17 shows the thermal printer unit of FIG. 6 installed in a POS device.

FIG. 17 shows the thermal printer unit 30 installed in the POS device 100. The thermal printer unit 30 is installed in the POS device 100 with the following steps. First, the setscrews 56 are removed, and the support assisting member 55 is detached (FIG. 6). Then, the platen module 50 is removed from the thermal printer unit 30. The main body module 31 with the thermal head module 70 attached thereto is arranged in the POS device main body 101. The L-shaped leg 32*c* of the main body module 31 is positioned on a base 102 provided inside the POS device main body 101. A hole 32*c*1 at the corner of the leg 32*c* is fitted to a hook 103 of the base 102. Then, the leg 32*c* is fixed to the base 102 with a screw 104. The platen module 50 is attached to a front end of the lid 110. The POS device 100 is thus assembled as shown in FIG. 17. The thermosensitive paper roll 13 is loaded into a roll housing 105, and the thermosensiteve sheet 14 is pulled out from the thermosensitive paper roll 13 through the upper side of the main body module 31 to the outside.

When the lid 110 is closed, the platen bearing 53 is engaged with the first hook lever 34 and the platen module 50 is connected to the main body module 31. In this state, the motor 33 can rotate the platen 52. The thermosensitive sheet 14 is held between the platen 52 and the thermal head 72 to be ready for the printing operations.

If a paper cutting operation is not properly performed for some reason, the movable blade 81 might be stopped at an advanced position with the thermosensitive sheet 14 stuck between the movable blade 81 and the stationary blade 54. Such a paper jam generated at the cutter 90 can be fixed with the following steps. The second hook lever 73 is rotated by using a lever (not shown) on an upper side of the POS device main body 101 so that the hook section 73*b* disengages the platen bearing 53. Then, the thermal head module 70 is slightly rotated about the engagement locking pin 35 in the clockwise direction. Thus, the movable blade 81 is displaced relative to the stationary blade 54 to release the thermosensitive sheet 14 therebetween. When the power is turned on again, a microcomputer executes reset operations. The motor mechanism of the movable blade unit 80 is driven to retract the movable blade 81 to a home position in the movable blade unit 80. In this way, the paper jam generated at the cutter 90 is fixed.

Figure 16:
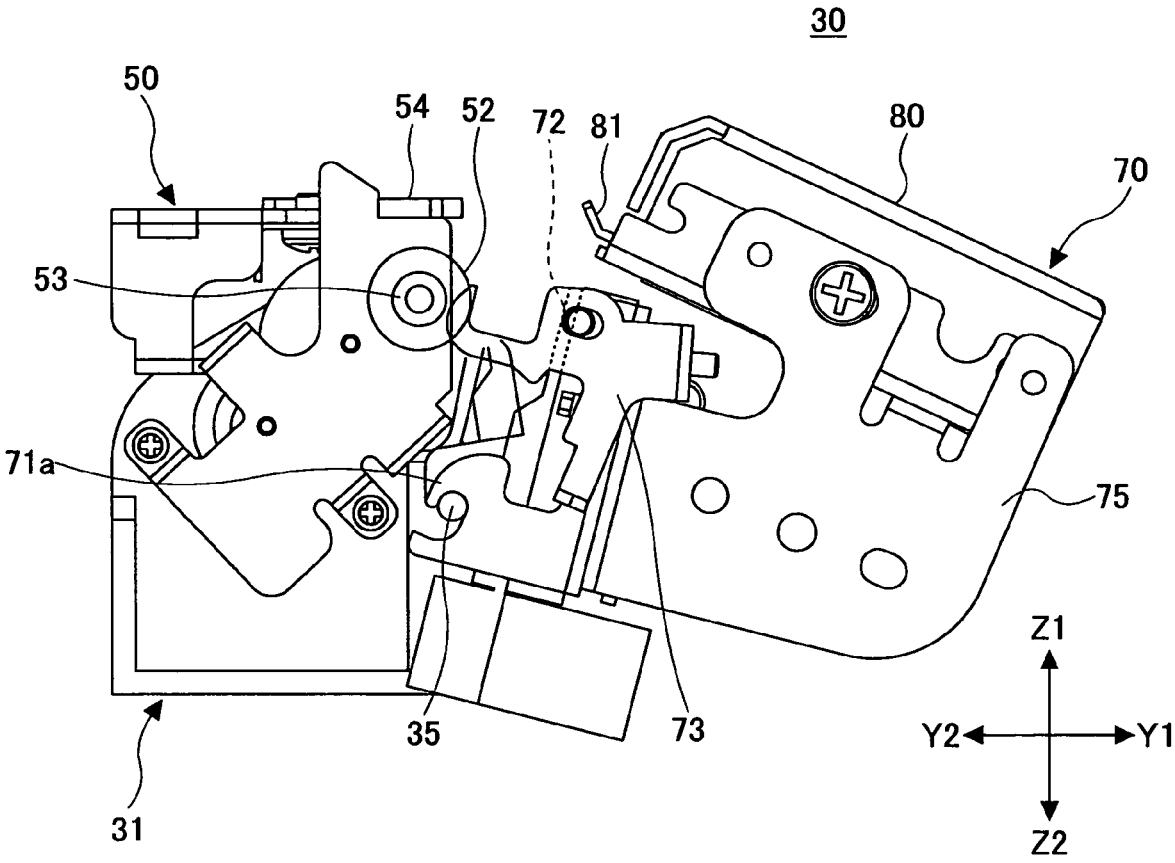
FIG. 16 shows the thermal printer unit with a thermal head separated from a platen.

For performing maintenance of the thermal head 72, a top cover of the POS device main body 101 is removed. Then, the lid 110 is opened, and the second hook lever 73 is operated to disengage the platen bearing 53. The thermal head module 70 is slightly rotated about the engagement locking pin 35 in the counterclockwise direction as shown in FIG. 16. In this state, maintenance can be performed.

[Installing Thermal Printer Unit 30 in Label Printer 120]

Figure 18:
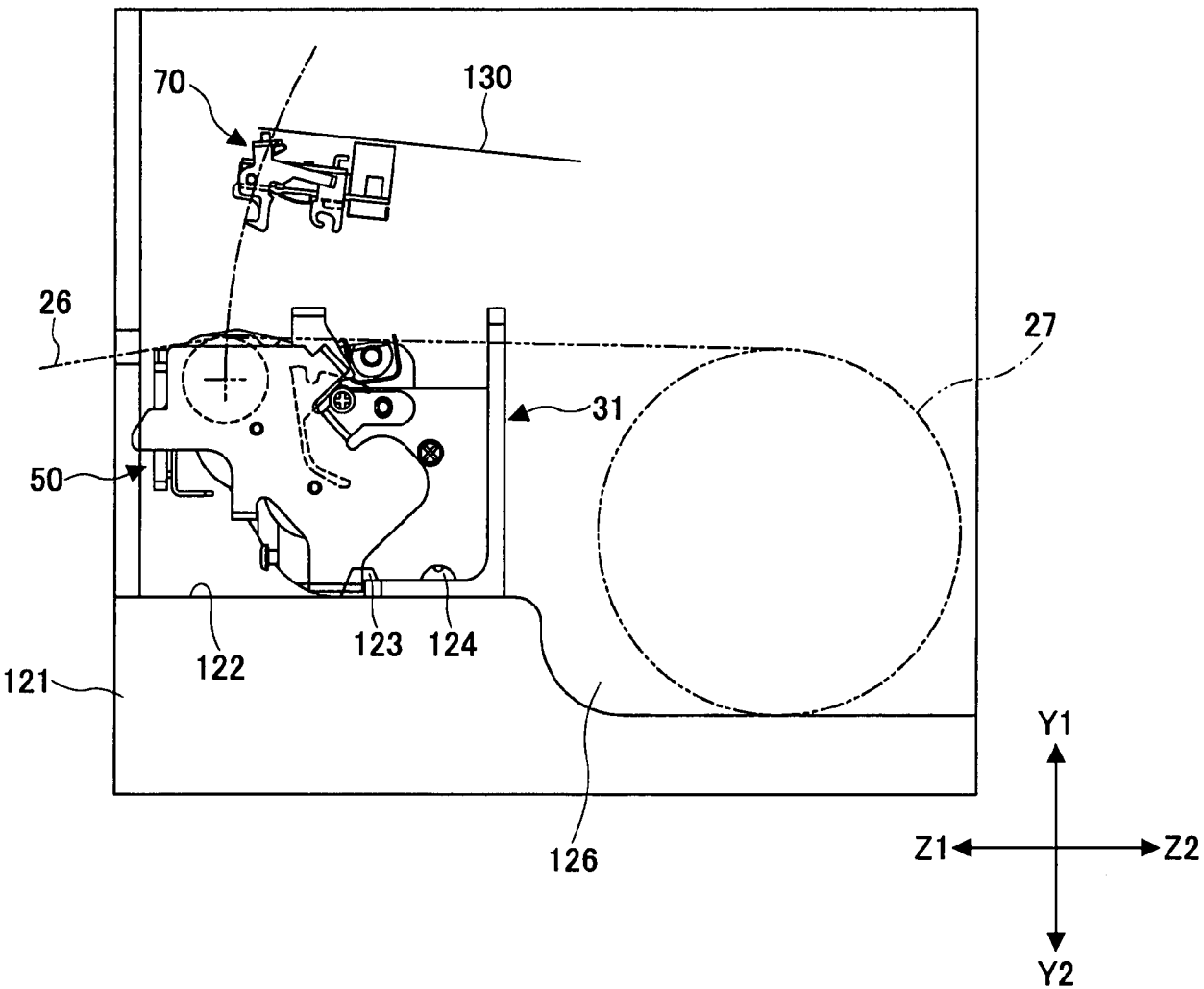
FIG. 18 shows the thermal printer unit of FIG. 6 installed in a label printer.

FIG. 18 show the thermal printer unit 30 installed in the label printer 120. The thermal printer unit 30 is installed in the label printer 120 with the following steps. First, the thermal head module 70 is removed from the thermal printer unit 30 as shown in FIG. 14. The main body module 31 with the platen module 50 attached thereto is arranged in the label printer main body 121. The L-shaped leg 32*c* of the main body module 31 is positioned on a base 122 provided inside the label printer main body 121. An end of the leg 32*c* is fitted to a hook 123 of the base 122. Then, the leg 32*c* is fixed to the base 122 with a screw 124. The thermal head module 70 is attached to the support member 130, which is configured to move in the Y2 direction while slightly displacing in the Z1 direction. The label printer 120 is thus assembled as shown in FIG. 18. The roll 27 is loaded from the lateral side of the label printer 120 into a roll housing 126, and the label sheet 26 is pulled straight out through the upper side of the main body module 31 to the outside.

Then, the second hook lever 73 is operated to rotate in the counterclockwise direction, and the support member 130 is moved in the Y2 direction. The second hook lever 73 is rotated in the clockwise direction to engage the platen bearing 53. The thermal head module 70 is thus connected to the platen module 50 and the main body module 31. In this state, the label sheet 26 is held between the thermal head 72 and the platen 52 to be ready for the printing operations.

Since the thermal head module 70 is connected to the platen bearing 53, the relative position of the thermal head 72 and the platen 52 is accurately set. Therefore, the printing on the label sheet 26 is finely and stably performed.

The thermal printer unit may be configured wherein, only by moving the support member 130 in Y2 direction without operating the second hook lever 73, a part of the second hook lever 73 abuts on the platen bearing 53 and is rotated to have the hook section 73*b* engage the platen bearing 53.

Second Embodiment

Figure 19:
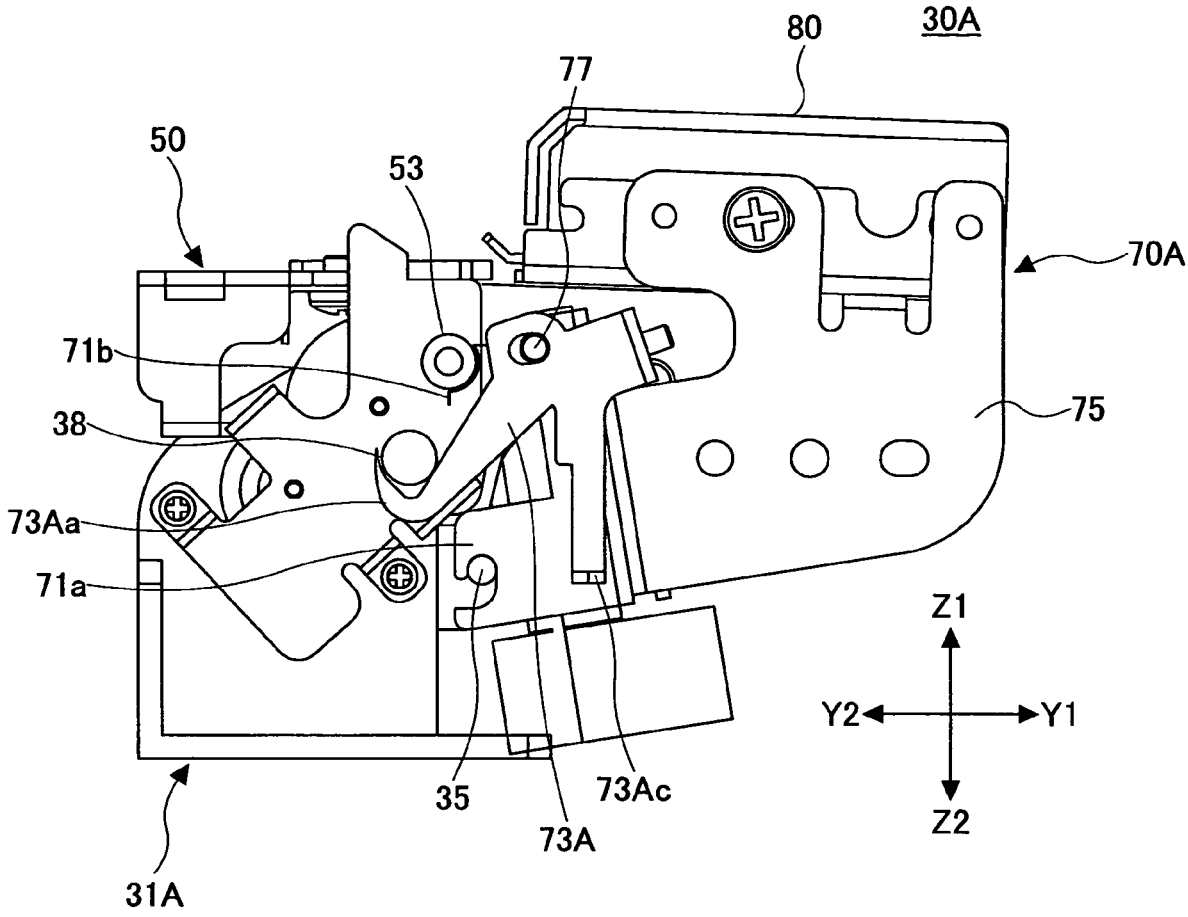
FIG. 19 is a perspective view showing a thermal printer unit as a second embodiment of the present invention.

FIG. 19 shows a thermal printer unit 30A according a second embodiment of the present invention. A main body module 31A has an engagement pin 38. A thermal head module 70A has a second hook lever 73A that engages the engagement pin 38. The hook section 71*a* engages the engagement locking pin 35. The bearing receiver 71*b* abuts on the platen bearing 53. The second hook lever 73A engages the engagement pin 38. In this way, the thermal head module 70A is connected to the main body module 31A with the platen module 50 attached thereto. The position where the second hook lever 73A engages the engagement pin 38 is located between the position where the bearing receiver 71*b* abuts on the platen bearing 53 and the position where the hook section 71*a* engages the engagement locking pin 35 in the Z1-Z2 direction.

The present application is based on Japanese Priority Application No. 2004-312722 filed on Oct. 27, 2004, with the Japanese Patent Office, the entire contents of which are hereby incorporated by reference.

What is claimed is:

1. A thermal printer unit, comprising:

a main body module;

a platen module including a supporting structure and a platen; and a thermal head module including a supporting structure and a thermal head;

wherein the main body module, the platen module and the thermal head module are separable from each other, the platen module and the thermal head module are configured to be individually detachably connectable to the main body module, the platen module is configured to be detachably connectable to the main body module to which the thermal head module is connected, and the thermal head module is configured to be detachably connectable to the main body module to which the platen module is connected.

2. The thermal printer unit as claimed in claim 1, wherein the thermal head module further includes clamping mechanisms configured to clamp bearings provided one for each end of a shaft of the platen of the platen module connected to the main body module.

3. The thermal printer unit as claimed in claim 1, wherein the thermal head module further includes clamping mechanisms configured to clamp bearings provided one for each end of a shaft of the platen of the platen module connected to the main body module, and hook sections each configured to engage a part of the main body module, and the thermal head module is connected to the main body module by the clamping mechanisms and the hook sections, after the platen module is connected to the main body module.

4. The thermal printer unit as claimed in claim 1, wherein the thermal head module further includes bearing receivers configured to receive bearings provided one for each end of a shaft of the platen of the platen module, hook sections each configured to engage a part of the main body module, and hook levers respectively disposed between the corresponding bearing receivers and the corresponding hook sections to engage the main body module, and the thermal head module is connected to the main body module by the hook sections each engaging a part of the main body module, the bearing receivers receiving the bearings and the hook levers engaging the main body, after the platen module is connected to the main body module.

5. The thermal printer unit as claimed in claim 1, wherein the platen module is arranged on an upper side of the main body module, and the thermal head module is arranged on a lateral side of the platen module and the main body module, the main body module and the thermal head module respectively have hook levers configured to engage bearings provided one for each end of a shaft of the platen of the platen module, the hook levers of the main body module are configured to approach the corresponding bearings from the thermal head module side to engage therewith, and the hook levers of the thermal head module are configured to approach the corresponding bearings from the main body module side to engage therewith.

6. The thermal printer unit as claimed in claim 5, wherein the thermal head module includes biasing force generating mechanisms configured to press the thermal head against the platen while the hook levers of the thermal head module engage the bearings provided one for each end of the shaft of the platen.

7. The thermal printer unit as claimed in claim 6, wherein each one of the biasing force generating mechanisms is configured to rotatably support corresponding one of the hook levers of the thermal head module while allowing a displacement of a rotation center of said one of the hook levers, including a spring member between said one of the hook levers and a back side of the thermal head, and each one the biasing force generating mechanisms generates a biasing force when the rotation center of said corresponding one of the hook levers is displaced to deform the spring member.

8. The thermal printer unit as claimed in claim 1, wherein the platen module further includes a stationary blade, the thermal head module further includes a movable blade and a movable blade unit that moves the movable blade, and the stationary blade and the movable blade unit serve as a cutter for cutting a sheet when the main body module, the platen module and the thermal head module are detachably connected to each other.

* * * * *